US008714854B2

(12) United States Patent
Schmidt et al.

(10) Patent No.: US 8,714,854 B2
(45) Date of Patent: May 6, 2014

(54) PENCIL

(75) Inventors: Ralf Schmidt, Rosstal (DE); Andreas Weber, Heroldsberg (DE); Clemens Wiesmann, Heroldsberg (DE)

(73) Assignee: Schwan-STABILO Cosmetics GmbH & Co. KG, Heroldsberg (DE)

( * ) Notice: Subject to any disclaimer, the term of this patent is extended or adjusted under 35 U.S.C. 154(b) by 200 days.

(21) Appl. No.: 12/267,154

(22) Filed: Nov. 7, 2008

(65) Prior Publication Data

US 2009/0129849 A1 May 21, 2009

(30) Foreign Application Priority Data

Nov. 12, 2007 (DE) ..... 20 2007 015 726 U

(51) Int. Cl.
*B43K 29/06* (2006.01)

(52) U.S. Cl.
CPC ..... *B43K 29/06* (2013.01)
USPC ..... 401/51; 401/50

(58) Field of Classification Search
USPC ..... 401/50, 51, 65, 66, 67, 179, 182
See application file for complete search history.

(56) References Cited

U.S. PATENT DOCUMENTS

| | | | | |
|---|---|---|---|---|
| 2,514,761 | A | 12/1947 | Havnen | |
| 2,636,476 | A * | 4/1953 | Milhavet | 401/51 |
| 2,907,301 | A * | 10/1959 | Spatz | 401/51 |
| 3,101,074 | A * | 8/1963 | Spatz | 401/51 |
| 3,209,730 | A * | 10/1965 | Aston | 401/76 |
| 3,232,276 | A * | 2/1966 | Kupersmith et al. | 401/51 |
| 7,086,796 | B2 * | 8/2006 | Severa | 401/179 |

FOREIGN PATENT DOCUMENTS

| | | |
|---|---|---|
| DE | 19616613 | 10/1997 |
| EP | 0382590 | 8/1990 |
| JP | 06-199093 | 7/1994 |
| JP | 7-231812 | 9/1995 |

OTHER PUBLICATIONS

International Search Report for PCT/EP2008/009398.

* cited by examiner

*Primary Examiner* — David Walczak
*Assistant Examiner* — Jennifer C Chiang
(74) *Attorney, Agent, or Firm* — Bachman & LaPointe, P.C.

(57) ABSTRACT

A pencil comprising a lead, a cartridge for at least partially receiving the lead, and a protective cap having a device for shaping the lead.

11 Claims, 3 Drawing Sheets

PENCIL

BACKGROUND OF THE INVENTION

The invention concerns a pencil comprising a lead, a cartridge for at least partially receiving the lead, and a protective cap having a device for shaping the lead.

Pencils of the above-indicated kind are known, for example from DE 196 16 613 C1. In accordance therewith the device for shaping the lead is in the nature of a sharpener. The sharpening operation is effected after fitment of the cap containing the sharpener by rotation of two sleeve portions relative to each other, whereby a rotary drive for the lead is actuated. A slipping clutch serves to limit the advance movement of the lead by the rotary drive.

U.S. Pat. No. 2,514,761 discloses a protective cap with integrated sharpener and a holder for a lead pencil. When the holder is rotated with respect to the protective cap with the sharpener, an advance movement of the lead pencil is effected until an abutment is reached. The advance movement is therefore restricted to a predetermined amount.

The object of the invention is to develop the pencil of the kind set forth in the opening part of this specification in such a way that handling thereof is simplified.

SUMMARY OF THE INVENTION

In accordance with the invention for that purpose there is provided a device responsive to fitment of the protective cap onto the cartridge for axial displacement of the lead with respect to the cartridge.

In accordance with the invention accordingly the advance movement required for shaping the lead is effected automatically when simply fitting the protective cap onto the cartridge without further measures being required. Handling is thus simplified.

The operation of shaping the lead can be effected independently of fitment of the protective cap onto the cartridge. Preferably in accordance with the invention however the device for shaping the lead is responsive to the protective cap being fitted onto the cartridge. In other words, preferably in accordance with the invention, two things happen when the protective cap is fitted onto the cartridge. On the one hand the lead is displaced axially with respect to the cartridge and on the other hand the lead is sharpened. Those two operations do not necessarily have to occur simultaneously. Rather, it can be provided that firstly the lead is axially displaced and then—in a second phase of the fitment procedure—shaping of the lead takes place.

In accordance with the invention the fitment operation can involve pushing on and/or screwing on the protective cap.

In accordance with the invention the shaping operation includes cutting and/or sharpening the lead.

In accordance with a particularly preferred embodiment of the invention the displacement device acts (exclusively) in the sense of pushing the lead out of the cartridge. That ensures that, after the lead has become blunt, a projecting length of the lead beyond the front end of the cartridge is always achieved by the protective cap being simply fitted onto the cartridge.

In a further preferred feature there is provided a device for limiting the displacement to a predetermined extent so that, possibly in matched relationship with the shaping device, fitting the protective cap onto the cartridge (and removing it again) leads to the provision of a defined working region of the lead.

Preferably in accordance with the invention the limiting device has an abutment on the cartridge. That affords a particularly simple solution.

The extent is advantageously between 0.5 mm and 1.1 mm, preferably between 0.6 mm and 1.0 mm, further preferably between 0.7 mm and 0.9 mm.

Preferably the pencil according to the invention has a shank which axially displaceably holds the cartridge and a first one-way clutch which couples the lead to the shank and which allows the lead to be pushed out of the cartridge but blocks it to prevent it from being pushed in. In that way the lead advance movement can be effected by displacement of the cartridge with respect to the shank.

In a further preferred feature there is provided a second one-way clutch which couples the cartridge to the lead and which allows the lead to be pushed out of the cartridge but blocks it to prevent it from being pushed in. That configuration serves to prevent the lead from moving in opposite relationship to the advance direction with respect to the cartridge when the cartridge is moved into its starting position again after advance movement of the lead has occurred.

The first and/or the second one-way clutch can have a pawl mechanism. That once again affords a mechanically particularly simple solution.

Preferably in accordance with the invention there is provided a device for biasing the cartridge with respect to the shank. That arrangement provides that, after the advance movement of the lead, the cartridge is automatically returned into its starting position again.

Further preferably according to the invention the protective cap has at least one blade for shaping the lead by cutting and/or sharpening.

In that case in a further preferred feature of the invention the blade can deflect against an elastic return force in the axial direction of the lead. That prevents an excessively great axial force in the cutting/sharpening operation.

However the blade can also be pivotable and/or deformable against an elastic return force.

In a particularly preferred embodiment of the invention the protective cap has at least one guide template. That guide template serves for cutting the lead along a predetermined cutting path.

In accordance with a particularly preferred embodiment of the invention, once again for absorbing excessive axial forces, it is provided that the guide template can deflect against an elastic return force in the axial direction of the lead.

Preferably the device for shaping the lead exerts no force on the lead in a rest position. More specifically for example an ongoing pressure on the lead in the event of prolonged storage or at elevated temperature, would have the result that the tip of the lead is crushed or pinched again after the sharpening operation.

In particular for the aforementioned reason, it is preferred in accordance with the invention to provide an axial abutment against which the device for shaping the lead bears in a rest position. More specifically that provides that it applies no force to the lead in the rest position.

BRIEF DESCRIPTION OF THE DRAWINGS

The invention is described in greater detail hereinafter by means of preferred embodiments with reference to the accompanying drawing in which.

DETAILED DESCRIPTION

Figure 1:
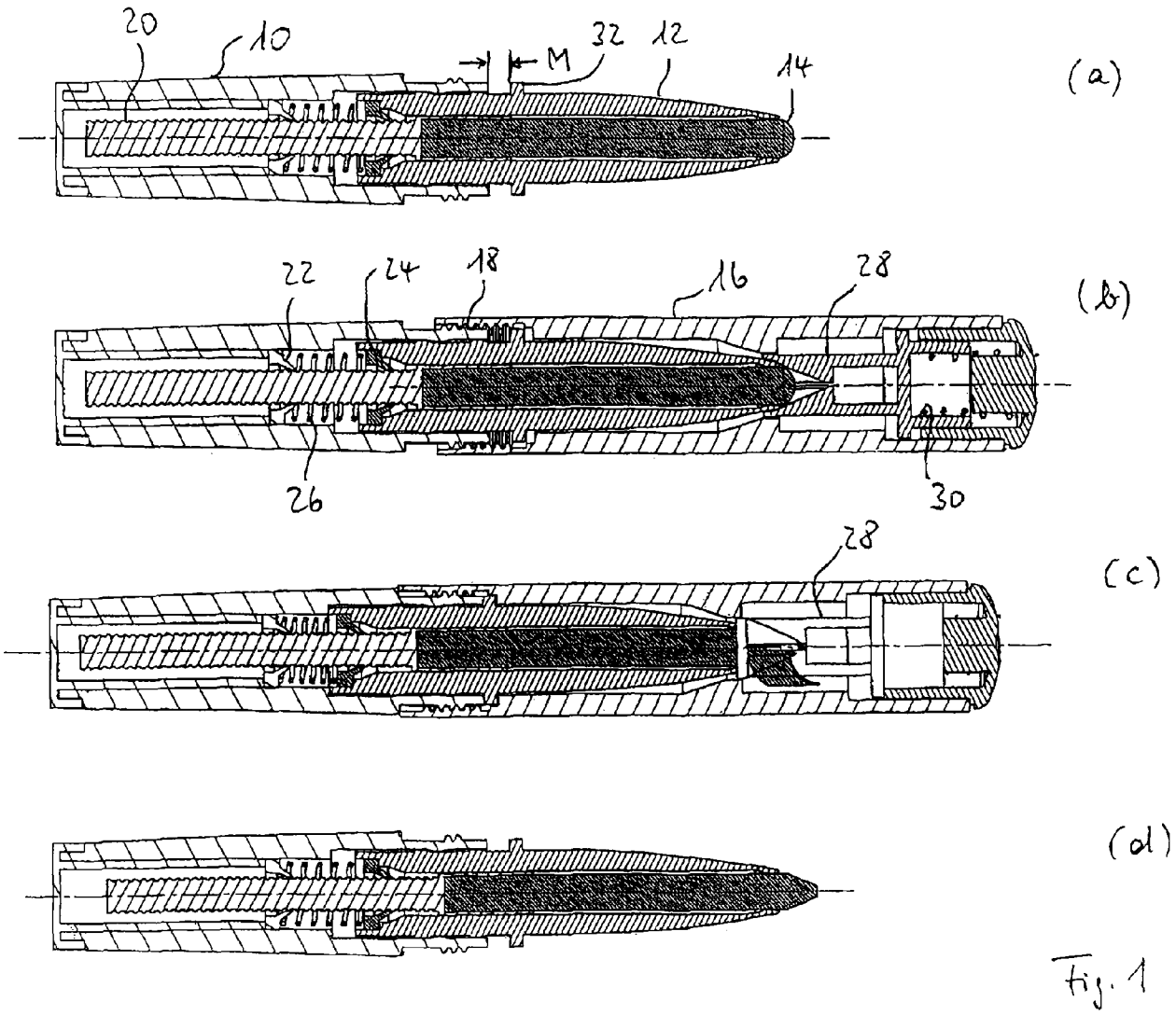
FIG. 1 shows diagrammatic views in longitudinal section of an embodiment of the pencil according to the invention in various operating conditions.

The pencil shown in FIG. 1 includes a shank 10, a cartridge 12, a stick or lead 14, a protective cap 16 which can be screwed onto the shank 10 by means of a screwthread 18, a spindle 20, a first pawl mechanism 22, a second pawl mechanism 24, a first coil spring 26, a sharpener 28 and a second coil spring 30.

The pencil shown in FIG. 1 functions as follows:

FIG. 1 (*a*) shows the pencil with a blunt lead 14. To sharpen the lead the protective cap 16 is screwed onto the shank 10, as shown in FIG. 1 (*b*). The screwthread 18 serves for that purpose. When the protective cap 16 is further screwed onto the shank 10 from the operating position shown in FIG. 1 (*b*), after a certain amount of screwing movement it bears against an axial abutment 32 on the cartridge 12 and pushes the cartridge 12 into the shank 10 until the abutment 32 bears against the cartridge 10. As a result the cartridge is displaced by the extent M which in the illustrated embodiment is 0.8 mm.

Because of the pawl mechanism 22 which engages into the spindle 20 neither the spindle 20 nor the lead 14 is displaced with the cartridge 12. Rather, the spindle 20 pushes the lead 14 out of the cartridge 12, more specifically by the amount M.

As the sharpener 28 moves together with the protective cap 16, that is to say on the one hand is rotated and on the other hand is displaced towards the left in the drawing, the lead 14 is sharpened. To prevent the sharpener 28 exerting excessive pressure on the lead 14, it is supported by way of the coil spring 30. It can accordingly deflect towards the right in the drawing.

As shown in the drawing the mere fact of screwing the protective cap 16 onto the shank 10 into the position shown in FIG. 1 (*c*) suffices to sharpen the lead 14.

When now the protective cap 16 is unscrewed from the shank 10 again, the spring 26, by way of the pawl mechanism 24, urges the spindle 20, the lead 14 and the cartridge 12 out of the shank 10 again so that the operating condition shown in FIG. 1 (*a*) is restored, but with the difference that the lead 14 has been sharpened and is extended out of the cartridge 12 by the distance M.

Figure 2:
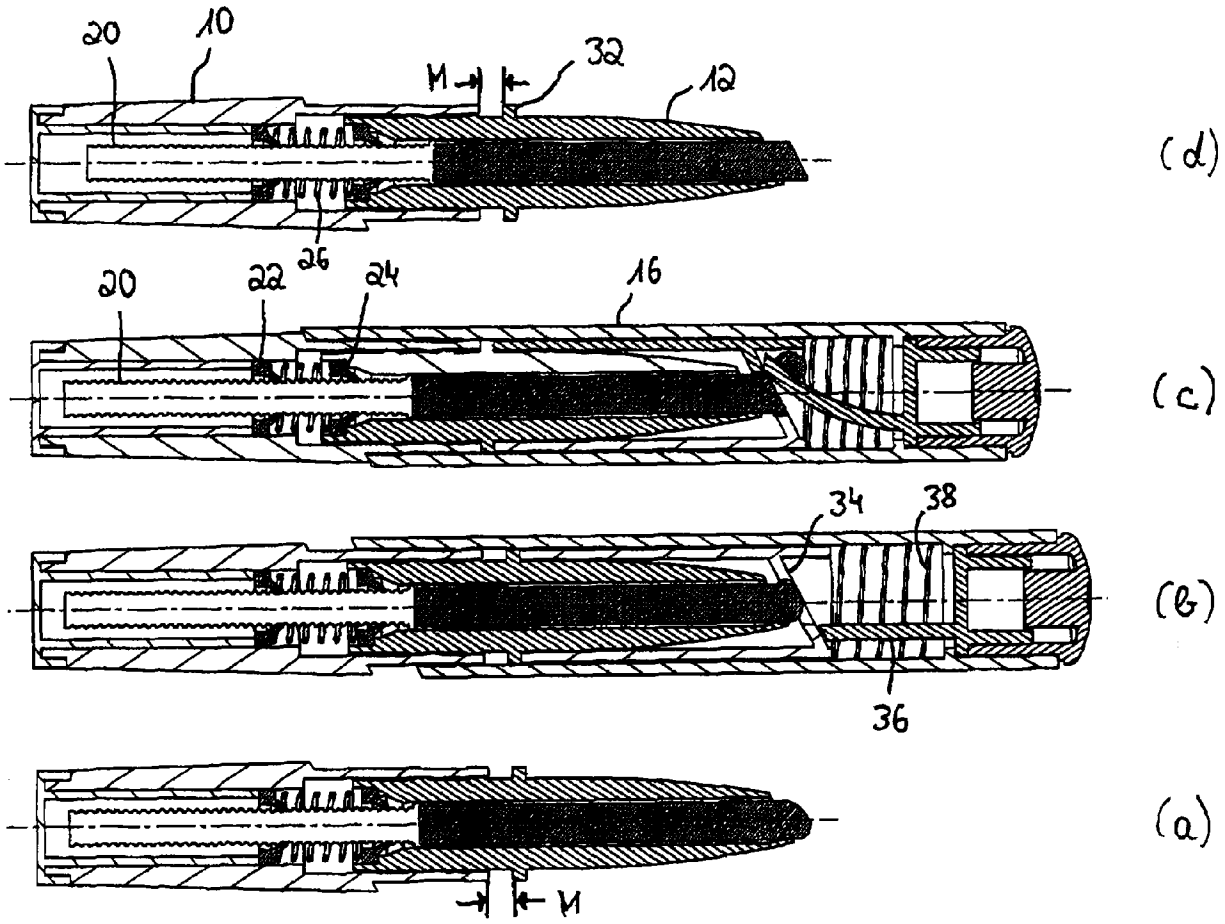
FIG. 2 shows the same views as FIG. 1 but of a second embodiment.

The embodiment shown in FIG. 2 substantially corresponds to that shown in FIG. 1 but with the difference that, instead of the sharpener 28, the arrangement has a guide template 34 and a flexible blade 36. In addition there is no screwthread for screwing the protective cap 16 onto the shank 10. Rather the protective cap 16 can be pushed onto the shank 10.

The FIG. 2 embodiment functions as follows:

FIG. 2 (*a*) once again shows the pencil with the blunt lead 14. When the protective cap 16 is pushed onto the shank 10 the guide template 34 bears against the abutment 32. That condition is shown in FIG. 2 (*b*). When the protective cap 16 is further pushed onto the shank 10, that provides that the guide template 34 pushes the cartridge 12 into the shank 10, by way of the abutment 32. In comparison the spindle 20 and the lead 14 are not displaced because of the pawl mechanism 22. Rather, the coil spring 26 is stressed.

When the abutment 32 bears against the shank 10 the protective cap 16 is displaced towards the left in the drawing with respect to the guide template 34. As a result the blade 36 slides transversely over the guide template, through which the lead 14 extends by virtue of the displacement thereof. As a result the lead 14 is cut off inclinedly. In that situation the guide template 34 bears against a coil spring 38 which is correspondingly stressed. That provides that the lead 14 is re-shaped again at its working end.

When thereafter the protective cap 16 is withdrawn from the shank 10 again, the pencil assumes the condition shown in FIG. 2 (*d*). For that purpose the coil spring 26 urges the pawl mechanism 24 and therewith the spindle 20 and the lead 14 out of the cartridge 12 by the distance M so that the condition shown in FIG. 2 (*a*) is restored, except that the lead 14 is no longer blunt.

Accordingly, the embodiment of FIG. 2 also provides that merely pushing the protective cap 16 onto the shank 10 is sufficient to suitably shape the lead 14 at its working end.

Figure 3:
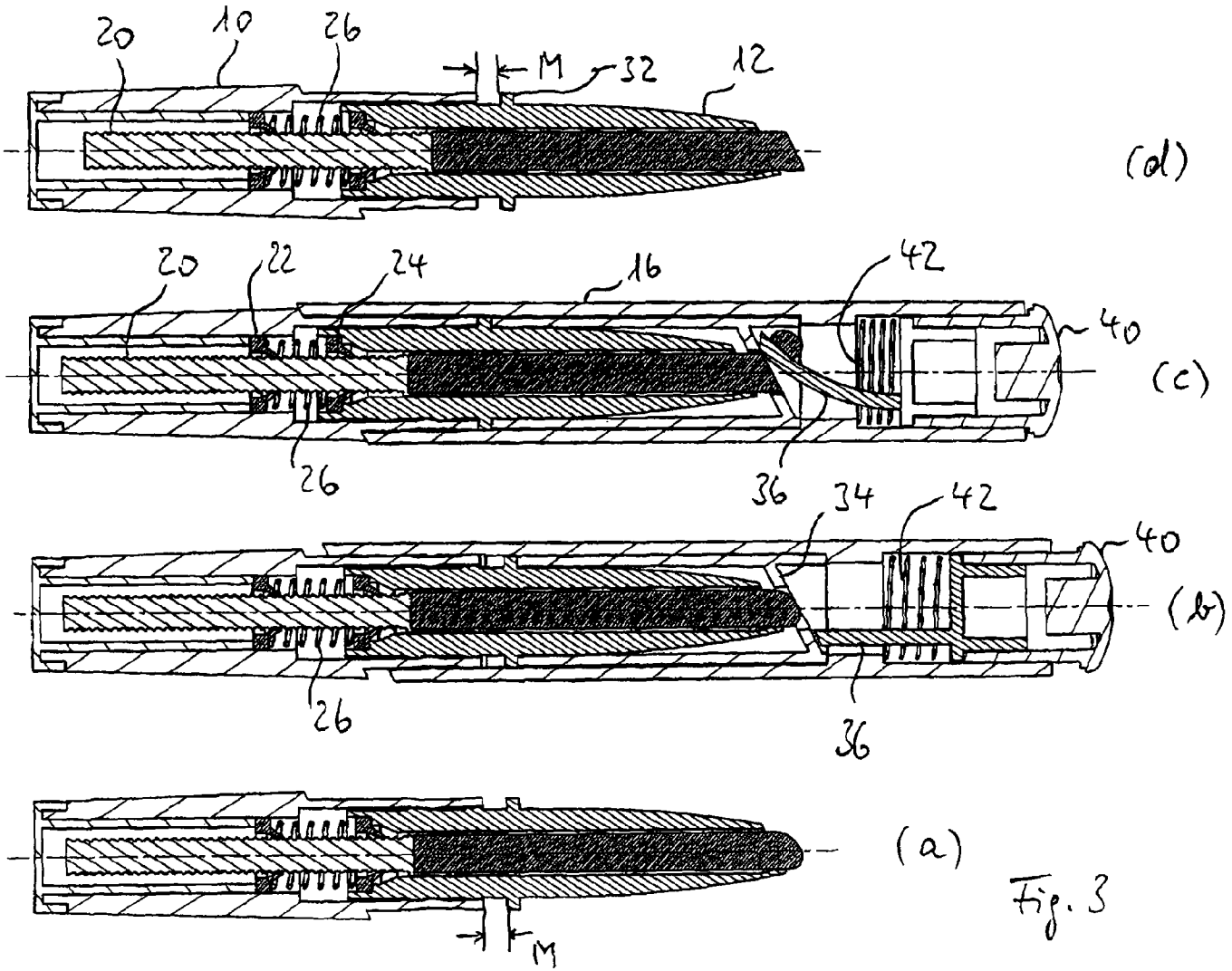
FIG. 3 shows the same views as FIGS. 1 and 2 but of a third embodiment.

The embodiment of FIG. 3 functions as follows:

FIG. 3 (*a*) again shows the pencil with a blunt lead 14. When the protective cap 16 is pushed onto the shank it bears against the abutment 32. That condition is shown in FIG. 3 (*b*). Further pushing movement of the protective cap 16 onto the shank 10 provides that the cartridge 12 is pushed into the shank 10 by means of the abutment 32. In comparison the spindle 20 and the lead 14 are not displaced because of the pawl mechanism 22. The coil spring 26 is stressed.

The protective cap 16 can be pushed onto the shank until the abutment 32 bears against the shank 10. That condition is shown in FIG. 3 (*c*). The view in FIG. 3 (*c*) also differs from that shown in FIG. 3 (*b*) however in that a knob 40 is depressed. Depressing the knob 40 causes the blade 36 to cut off the lead 14 by virtue of the blade traveling along the guide template 34. In that case a coil spring 42 is stressed, which moves the blade 36 into its starting position again when the knob 40 is released.

When the protective cap 16 is withdrawn from the shank 10 again after the lead 14 has been cut off, the pencil assumes the condition shown in FIG. 3 (*d*). For that purpose the coil spring 26 urges the pawl mechanism 24 and therewith the spindle 20 and the lead 14 out of the cartridge 12 by the extent M so that the condition shown in FIG. 3 (*a*) is restored, except that the lead 14 is no longer blunt.

As the foregoing description shows, in the embodiment of FIG. 3 the mere fact of pushing the protective cap 16 onto the shank 10 is also sufficient to displace the lead 14 axially within the cartridge 12 for shaping purposes.

The features of the invention disclosed in the foregoing description, the claims and the drawing can be essential both individually and also in any combinations for implementing the invention in its various embodiments.

Points of explanation in relation to FIG. 1:

a) blunt lead
b) cartridge is pushed back
c) sharpening of the lead
d) sharp lead ready for makeup

The invention claimed is:

1. A pencil comprising:

a hollow shank;

a cartridge partially received in the shank and axially movable therein between an operating position and a shaping position a distance (M);

a lead partially received in the cartridge, wherein the cartridge, when moved from the operating position to the shaping position the distance (M), moves relative to the lead to expose a length of lead to be shaped; and a protective cap having a device for shaping the lead, wherein the protective cap is movable on the shank to axially move the cartridge from the operating position to the shaping position.

2. A pencil as set forth in claim 1 wherein the cartridge has an abutment for limiting the movement of the cartridge to the distance (M).

3. A pencil as set forth in claim 1 wherein the distance (M) is between 0.5 mm and 1.1 mm.

4. A pencil as set forth in claim 1, wherein the hollow shank houses a first one-way clutch which couples the lead to the shank and allows the lead to extend from the cartridge when the cartridge is moved from the operating position to the shaping position and prevents the lead from being pushed in the cartridge.

5. A pencil as set forth in claim 4 further including a second one-way clutch which couples the cartridge to the lead and which allows the lead to extend from the cartridge and prevents the lead from being pushed in the cartridge.

6. A pencil as set forth claim 5 wherein the first and the second one-way clutch have a pawl mechanism.

7. A pencil as set forth in claim 1 wherein the protective cap has at least one blade for shaping the lead.

8. A pencil as set forth in claim 7 wherein the blade can deflect against an elastic return force in the axial direction of the lead.

9. A pencil as set forth in claim 7 wherein the blade is pivotable and/or deformable against an elastic return force.

10. A pencil as set forth in claim 1 wherein the protective cap has at least one guide template.

11. A pencil as set forth in claim 10 wherein the guide template can deflect against an elastic return force in the axial direction of the lead.

* * * * *